US006120071A

United States Patent [19]

Picard et al.

[11] Patent Number: 6,120,071

[45] Date of Patent: Sep. 19, 2000

[54] MORTISE LATCH VERTICAL ROD EXIT DEVICE

[75] Inventors: Daniel J. Picard, Oakville; Darren C. Eller, East Lyme, both of Conn.

[73] Assignee: Sargent Manufacturing Company, New Haven, Conn.

[21] Appl. No.: 09/236,778

[22] Filed: Jan. 22, 1999

[51] Int. Cl.[7] ..... E05C 1/12

[52] U.S. Cl. ..... 292/165; 292/DIG. 21

[58] Field of Search ..... 292/340, 341.15, 292/341.17, 332–335, DIG. 72, DIG. 21, 165, 169, 92; 70/486–487, 157, 131, 142, 92

[56] References Cited

U.S. PATENT DOCUMENTS

| | | | |
|---|---|---|---|
| 395,540 | 1/1889 | Borchard | 292/146 |
| 444,730 | 1/1891 | Shinn . | |
| 842,270 | 1/1907 | Taylor | 70/486 |
| 1,126,560 | 1/1915 | Page | 70/157 X |
| 1,158,845 | 11/1915 | Prinzler | 70/157 X |
| 1,346,670 | 7/1920 | Page . | |
| 1,850,222 | 3/1932 | Carlson . | |
| 2,019,528 | 11/1935 | Ellison | 20/16 |
| 2,029,901 | 2/1936 | Voigt | 292/92 |
| 2,056,537 | 10/1936 | Schatzlein | 292/340 |
| 2,107,300 | 2/1938 | Kilpatrick | 70/142 X |
| 2,505,190 | 4/1950 | Kulbersh | 292/92 |
| 2,594,253 | 4/1952 | Vander Veer | 292/92 |
| 3,375,687 | 4/1968 | Foster . | |
| 3,420,561 | 1/1969 | Russell et al. . | |
| 3,621,686 | 11/1971 | Klein . | |
| 3,672,714 | 6/1972 | Schultz | 292/34 |
| 3,808,849 | 5/1974 | Alexander | 70/149 |
| 3,819,213 | 6/1974 | Vanderburgh | 292/21 |
| 3,999,411 | 12/1976 | Kambie | 70/144 |
| 4,099,753 | 7/1978 | Gwozdz et al. | 292/177 |
| 4,262,504 | 4/1981 | Inoue | 70/151 R |
| 4,283,882 | 8/1981 | Hubbard et al. | 49/141 |
| 4,311,329 | 1/1982 | Kral | 292/92 |
| 4,322,958 | 4/1982 | Eigemeier | 70/107 |
| 4,596,411 | 6/1986 | Geringer et al. | 292/165 |
| 4,840,050 | 6/1989 | Gotanda | 70/107 |
| 4,961,330 | 10/1990 | Evans | 292/21 |
| 5,061,022 | 10/1991 | Meriwether | 312/324 |
| 5,498,038 | 3/1996 | Simon et al. | 292/36 |
| 5,588,686 | 12/1996 | Riley et al. | 292/92 |
| 5,757,269 | 5/1998 | Roth et al. | 340/542 |
| 5,941,581 | 8/1999 | Heithe | 292/332 |

*Primary Examiner*—B. Dayoan
*Assistant Examiner*—Gary Estremsky
*Attorney, Agent, or Firm*—DeLio & Peterson, LLC

[57] ABSTRACT

A mortise latch and vertical rod exit device latches at a center point between two doors and at top points between each door and the door frame. Optionally vertical rods may also be used to latch at bottom points between the doors and the floor. The latch includes an active and a passive latch mechanism operated by corresponding operating mechanisms. The mortise latch mechanisms cooperatively interact so that either door may be opened first, and either door may be closed first, without regard to the position of the other door. The active mortise latch mechanism includes a latch bolt and an activation bolt arranged so that one bolt is retracted when the other is extended, except when the doors are being opened or closed, when both bolts are retracted. The active mortise latch mechanism automatically retracts the latch bolt when the doors are not aligned and automatically extends the latch bolt when the doors are aligned. The passive mortise latch mechanism ejects the latch bolt as needed to allow the passive door to be opened first.

21 Claims, 7 Drawing Sheets

MORTISE LATCH VERTICAL ROD EXIT DEVICE

BACKGROUND OF THE INVENTION

1. Field of the Invention

This invention relates to exit devices using latch mechanisms mortised into the door, particularly mortise latch mechanisms used in combination with vertical rod latch assemblies. More specifically, this invention relates to mortise latch mechanisms suitable for use in both single and double door installations.

2. Description of Related Art

Exit devices using vertical rod mechanisms to latch the door at the top and bottom are widely used in public buildings, particularly where provision must be made for rapid operation in an emergency to evacuate the building. Such devices usually employ a push rail, a push bar, an emergency push plate or a similar type of opening mechanism that operates with inward pressure. This allows the exit device to open quickly and reliably under the pressure of a large number of people trying to exit the building in an emergency.

Vertical rod exit devices are often used on double door installations where both doors can be opened to provide a large and unobstructed exit. Conventional vertical rod exit devices, however, suffer from numerous problems. Typically, the vertical rod exit device will have two externally mounted vertical rods. One vertical rod will extend upward from the push rail to a latch mechanism mounted near the upper edge of the door. The upper latch will engage a strike plate set into the frame above the door. A second vertical rod will extend vertically downward to a latch mechanism mounted near the bottom edge of the door. The lower latch will engage a strike plate set into the floor.

One problem with this design is that the downwardly extending rod, when surface mounted on the door, will interfere with the use of the door. The lower rod tends to catch and obstruct wheelchairs and carts passing through the door, particularly when the door is provided with an automatic closure device that continuously urges the door towards the closed position. This pressure forces the face of the door and the surface mounted lower vertical rod into the path of the cart or wheelchair. Although vertical rod designs are known in which the rods are mounted inside the door, such solutions are expensive and not easily retrofitted to existing doors.

Another difficulty with the lower vertical rod is that the bottom latch must engage a strike plate in the floor. The floor mounted strike plate poses a tripping hazard which is a liability concern.

Removal of the lower rod, however, compromises the security of the door as the door is now latched only by the upper latch. The length of the door allows significant force to be exerted against the single upper latch. One solution to this security problem is to use a center latch mechanism in combination with the upper vertical rod latch. A mortise latch design for the center latch is considered to be one of the more secure types of latch for use at the center position. While this arrangement (a single vertical rod latch at the top and a center latch) is effective in single door applications, the center latch causes difficulties in double door applications.

The principal difficulty with prior art double door applications has been in coordinating operation of the center latch when the two doors are used independently. In double door designs with only vertical rod latches and no center latch, the double doors may be identical mirror images, with each one operating independently of the other. In double door designs using a center latch however, one of the two doors will be an active door, including a latch bolt which extends out from the active door and engages an opening in the passive door. It Is this active latch bolt that causes the difficulty because it needs to be retracted when either door is being opened or closed.

In one design for center latched vertical rod double doors, the latch bolt on the active door is retracted by the opening mechanism on the active door (usually a push rail) and is spring loaded with an inclined strike surface so that it automatically retracts when the active door closes against an angled strike plate on the closed passive door. In this design, the passive door is manually latched in position at the top and bottom and can only be opened or closed when the active door is being held open. Because the passive door lacks a push rail opening mechanism, and cannot be closed when the active door is closed, it cannot function as a conventional door and is of limited value in an emergency.

Other improved designs allow the passive door to be opened regardless of the state of the active door, as needed in an emergency, but the passive door still cannot be closed unless the active door is held open. Thus, these designs do not allow the passive door to be used for normal operation. Heretofore, all double door vertical rod systems employing a center latch mechanism have had some limitation on the order of opening or closing the passive door relative to the open or closed position of the active door.

Bearing in mind the problems and deficiencies of the prior art, it is therefore an object of the present invention to provide a mortise style center latch mechanism suitable for use in single and double door applications and for use in combination with single or double vertical rod latch mechanisms which allows each door of a double door combination to be operated independently without regard to the open or closed position of the other door.

SUMMARY OF THE INVENTION

The above and other objects, which will be apparent to those skilled in the art, are achieved in the present invention which relates to an active mortise latch mechanism for mounting in the edge of a door. The active mortise latch mechanism is contained within a case having an edge surface for mounting approximately flush with the edge of the door. A latch bolt and an activation bolt each moves between an extended and a retracted position relative to the edge surface of the case. A retractor is pivotally connected between the latch bolt and the activation bolt and is active to retract the latch bolt when the activation bolt is extended. This construction causes the latch bolt to extend when both the active and passive doors are closed and to retract when either door is open.

In the preferred design, a latch bolt spring is connected to extend the latch bolt when the activation bolt is in the retracted position, and an activation bolt spring is connected to extend the activation bolt. The activation bolt spring has sufficient strength to extend the activation bolt and retract the latch bolt whenever the activation bolt is not obstructed. In this implementation the latch bolt includes a push surface and the latch bolt may be pushed to the retracted position to open the doors even when the activation bolt is in the retracted position.

In one aspect of the invention the retractor includes first and second relatively movable portions, the first retractor portion contacting the latch bolt and the second retractor portion contacting the activation bolt. The relative motion between the two portions allows the latch bolt to be pushed to the retracted position when the activation bolt is also in the retracted position. The latch bolt spring comprises a first latch bolt spring operating between the first portion of the retractor and the latch bolt and a second latch bolt spring operating between the first portion of the retractor and the second portion of the retractor.

The active mortise latch mechanism is designed to operate in combination with an operating mechanism. The operating mechanism includes a chassis having a surface for mounting on a face of the door in close proximity to the case of the mortise latch mechanism and an opening mechanism, such as a push rail, push bar, push plate, or a conventional rotating handle of some type. The opening mechanism is movably mounted to the chassis for motion between an open and a closed position, and an operating member is driven by the opening mechanism as it moves to operate the active mortise latch. The operating member projects through the chassis surface into the case of the mortise latch mechanism and moves the latch bolt to the retracted position when the opening mechanism is moved to the open position.

The operating mechanism also preferably includes at least one vertical rod extending to a vertical rod latch mechanism adapted for mounting near an upper edge of the door. In one embodiment of the invention the operating mechanism may also drive a second vertical rod extending downward to a vertical rod latch mechanism adapted for mounting near a lower edge of the door. This double vertical rod with center latching is suitable for high security applications.

In a single door application the latch bolt from the active mortise latch mechanism extends into an opening in a strike plate mounted in the door frame. In the most highly preferred embodiment, however, the active mortise latch mechanism operates in combination with a passive mortise latch mechanism mounted in a passive door and the latch bolt extends into an opening in the edge surface of the case of the passive mortise latch mechanism.

The passive mortise latch mechanism includes a pusher slide movable between receiving and ejecting positions and the pusher slide has a pusher surface for pushing and ejecting the latch bolt of the active mortise latch mechanism from the opening in the case of the passive mortise latch mechanism when the pusher slide is in the ejecting position. The pusher slide is operated by at least one, and preferably two, pivot arms pivotally mounted to the case of the passive mortise latch mechanism. A second operating mechanism is mounted on the passive door and is operatively connected to the passive mortise latch mechanism to move the pusher slide to the ejecting position when a second opening mechanism, i.e. a push rail or the like, is moved to the open position.

BRIEF DESCRIPTION OF THE DRAWINGS

The features of the invention believed to be novel and the elements characteristic of the invention are set forth with particularity in the appended claims. The figures are for illustration purposes only and are not drawn to scale. the invention itself, however, both as to organization and method of operation, may best be understood by reference to the detailed description which follows taken in conjunction with the accompanying drawings in which:

DESCRIPTION OF THE PREFERRED EMBODIMENT(s)

In describing the preferred embodiment of the present invention, reference will be made herein to FIGS. 1–7 of the drawings in which like numerals refer to like features of the invention.

Figure 1:
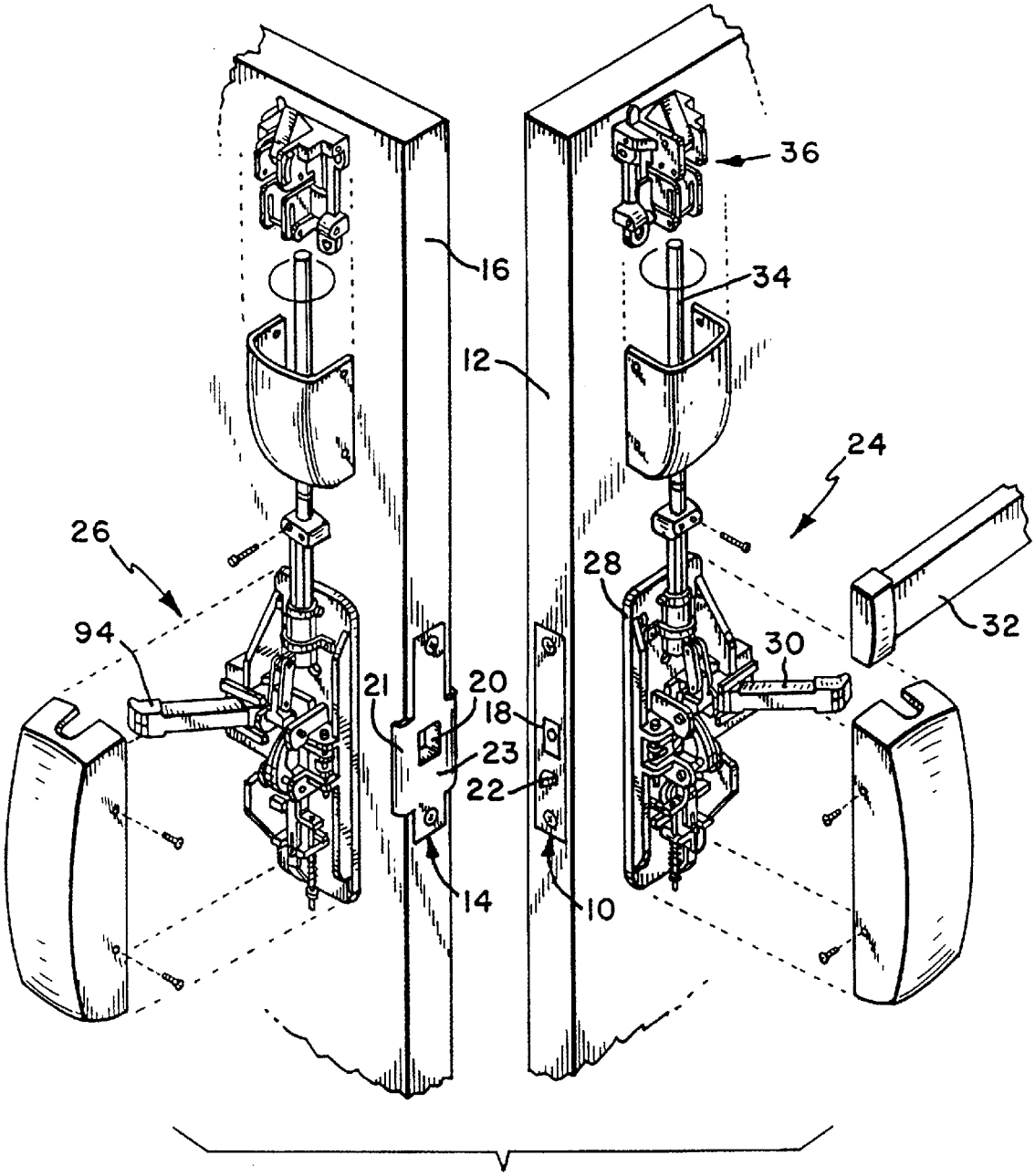
FIG. 1 is a perspective view showing an active mortise latch mechanism according to the invention mounted in an active door and a passive mortise latch mechanism according to the invention mounted in a passive door. Corresponding operating mechanisms, partially exploded, are also shown mounted on the face of the doors, with single upper vertical rods and upper vertical rod latch mechanisms.

FIG. 1 shows the preferred embodiment of the present invention installed in a double door configuration. The invention includes an active mortise latch mechanism 10 installed in an active door 12 and a passive mortise latch mechanism 14 installed in a passive door 16. The active mortise mechanism includes a latch bolt 18 (shown retracted) which engages an opening 20 in the passive mortise latch mechanism when the doors are closed and aligned. Although the doors are referred to here as the "active" door and the "passive door", as will be clear from the description below, these terms are used for convenience only. Both doors may be freely opened or closed without regard to the open or closed position of the other door.

An activation bolt 22, shown in the extended position in FIG. 1, is pushed back into the retracted position inside active mortise latch 10 when the doors are closed. In the retracted position, the activation bolt 22 allows the latch bolt 18 to move from the retracted position (shown in FIG. 1) to the extended position (shown in FIG. 5). When extended, the latch bolt 18 of the active mortise mechanism engages opening 20 of the passive mortise mechanism effecting the latching of the two doors at the center latching point.

Operating mechanisms 24 and 26 are mounted on the front surfaces of the active door 12 and passive door 16, respectively. The operating mechanisms provide the force to operate their respective active or passive mortise latch mechanisms and the other latching mechanisms on the door, when the door is opened.

The first operating mechanism 24 includes a chassis 28, an arm 30, an opening mechanism 32, at least one vertical rod—such as upper vertical rod 34 and a vertical rod latch mechanism 36.

The opening mechanism 32 may be a push rail of the type illustrated in FIG. 1, or it may be a push bar, a push plate, or in modified embodiments of the invention, it may be some form of handle which rotates or otherwise provides the needed force to drive the operating mechanism. In the design shown, the push rail 32 is conventional. When the door is to be opened, the push rail 32 is pressed toward the face of the active door 12 which drives arm 30 inwards.

Figure 7:
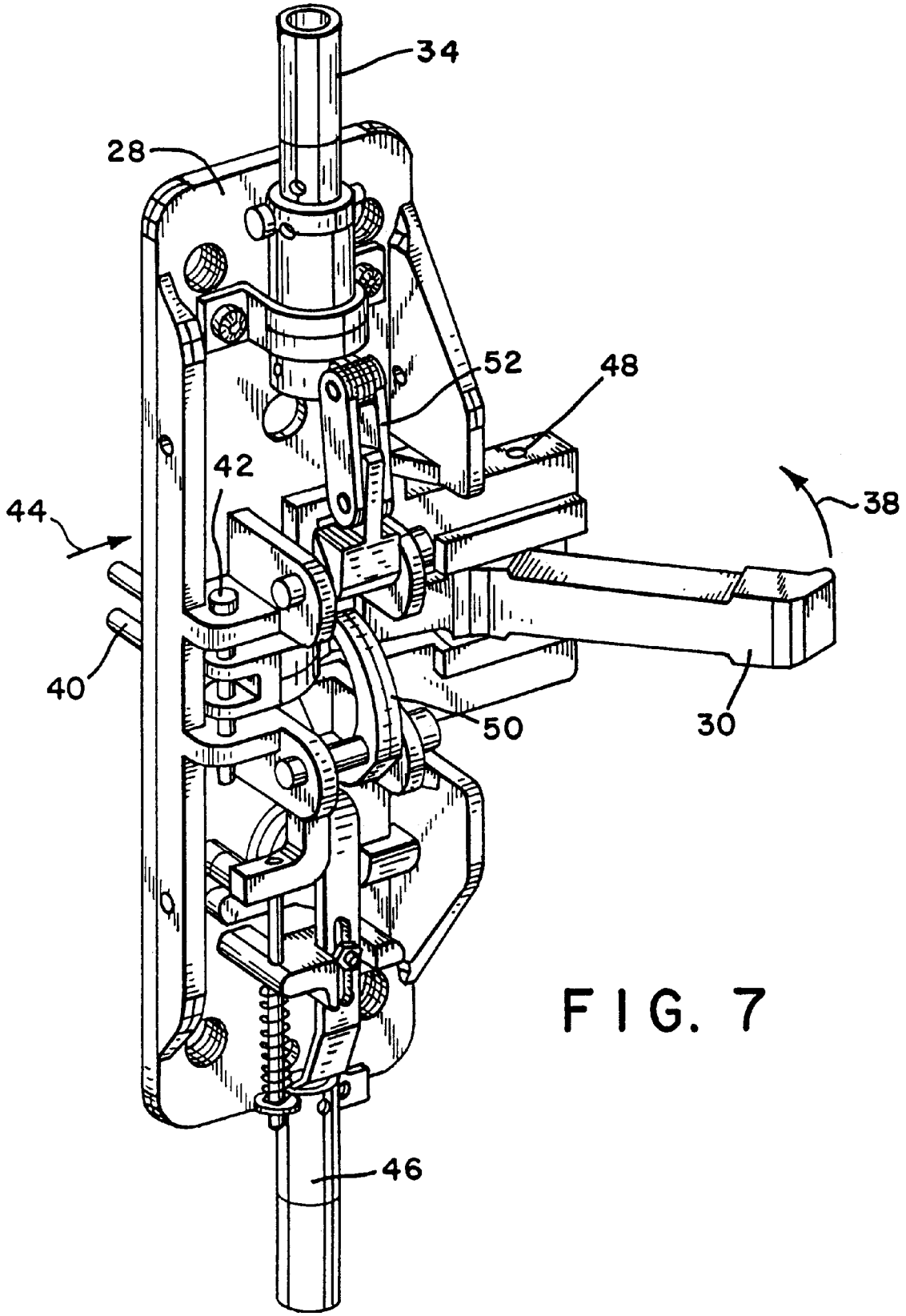
FIG. 7 is a perspective view of the operating mechanism for the active mortise latch seen in FIG. 1. The cover has been removed for clarity and two vertical rods are illustrated.

Referring to FIG. 7, arm 30 swings towards the door in the direction shown with arrow 38. Arm 30 is pivoted on the operating mechanism chassis 28 and this pivoting motion is transferred to operating member 40 which pivots on pivot 42. This moves the operating member in the direction generally indicated with arrow 44 as the opening mechanism is moved from the closed position towards the open position. As arm 30 moves in the direction of arrow 38, it also pulls on vertical rod 34 through linkage 52 to unlatch vertical rod latch mechanism 36 at the top of the door. Vertical rod latch mechanism 36 engages a strike plate in the door frame above door 12, and when vertical rod 34 is pulled by the operating mechanism, the vertical rod latch mechanism disengages from its strike plate to allow the door to open.

The lower vertical rod 46 shown in FIG. 7 is optional. It may be used in high security environments, however, in many applications it will be desirable to eliminate the lower vertical rod 46 allowing wheelchairs, carts and other large or bulky items to freely slide past the face of door 12 without being obstructed by a lower vertical rod.

As the push rail is pressed inward, the inward motion of arm 30 is converted via pivot 48 to an outward motion at the opposite end of the arm. This outward motion is transferred via pivoting member 50 and link 52 to retract vertical rods 34 and 46 (if installed). As may be seen in FIG. 7, the operating member 40 extends through the front face of the active door into the active mortise latch mechanism 10 to operate the active mortise latch mechanism and to retract the latch bolt 18 when push rail 32 is pressed.

The second operating mechanism 26 is mounted on the passive door 16 to operate the passive mortise latch mechanism 14. Operating mechanism 26 is substantially identical to operating mechanism 24 except that it is a mirror image thereof, and accordingly no detailed description of that mechanism is provided herein. Like the first operating mechanism 24, the second operating mechanism 26 has an arm (reference numeral 94 in FIG. 1) and an operating member (reference numeral 88 and 88' in FIG. 3) which moves towards the hinged side of the door when the arm is moved by the opening mechanism.

Figure 2:
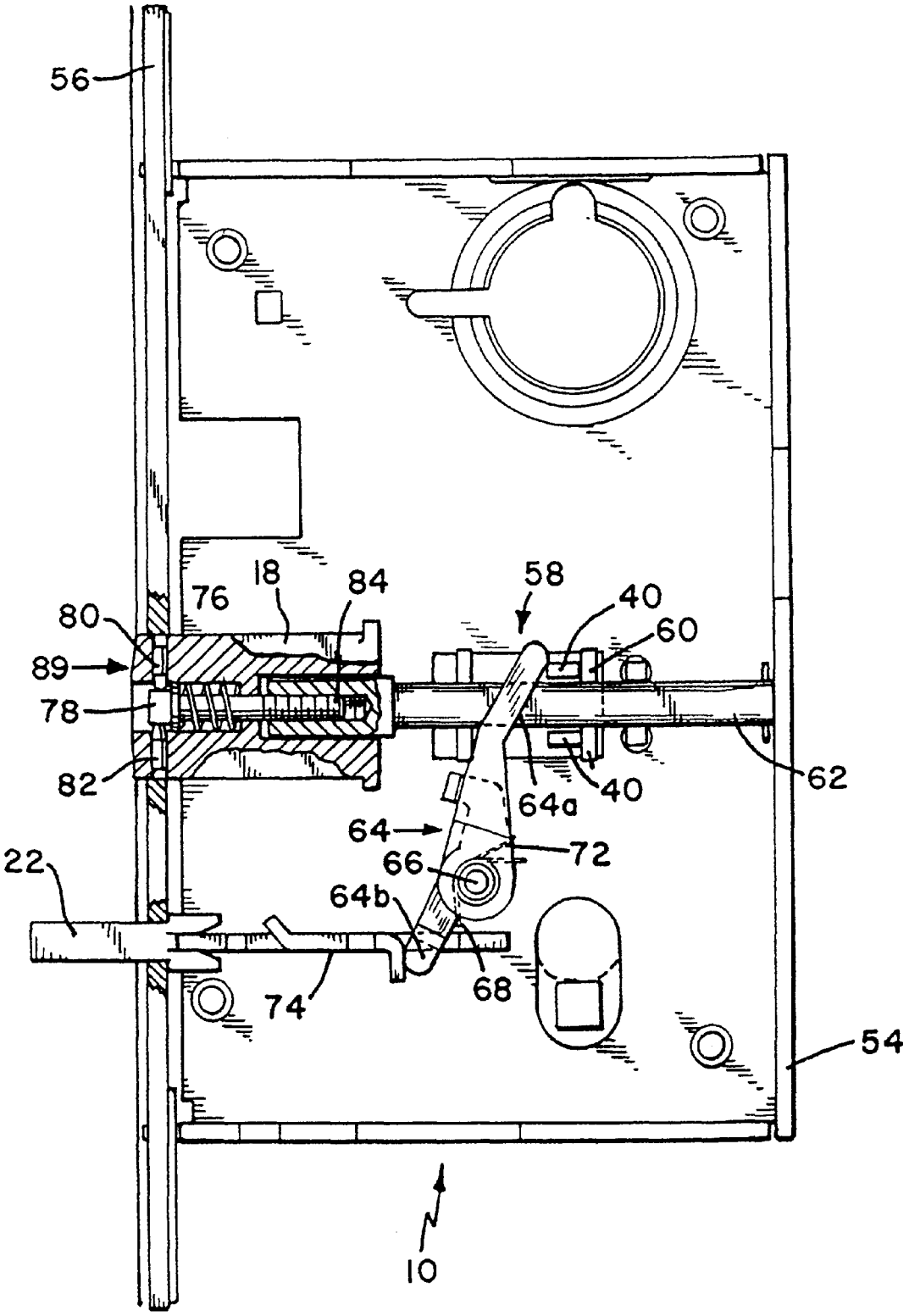
FIG. 2 is a front elevational view of the active mortise latch mechanism of the invention with the cover removed to show the internal mechanism. The active mortise latch mechanism is in the open position with the latch bolt retracted and the activation bolt extended.

FIG. 2 shows the active mortise latch mechanism 10 in detail. It includes a case 54 having an edge surface 56 which is flush mounted in the edge of door 12 (as seen in FIG. 1). FIG. 2 shows the activation bolt 22 in the extended position and the latch bolt 18 in the retracted position, as they appear in FIG. 1. The two bolts are in this position whenever the active door is not aligned with the passive door (or not aligned with its door frame in a single door installation). This happens whenever the active door is open or when the passive door is open in a double door installation, as shown.

The case of the active mortise latch mechanism includes an operating opening 58 which receives the forked end of the operating member 40 (see FIG. 7). In FIG. 2, the operating member 40 is shown in the position it achieves when the opening mechanism 32 is pressed inward to the open position. This moves the operating member 40 to the right, as seen in FIG. 2, and retracts the latch bolt 18 by contacting tail plate 60. Tail plate 60 is connected through tail 62 to latch bolt 18. Latch bolt 18 and activation bolt 22 are coupled through retractor 64 composed of a first portion 64*a* and a second portion 64*b*. The retractor 64 is designed so that when neither the latch bolt nor the activation bolt are obstructed, these two bolts operate in opposition to each other. The latch bolt extends when the activation bolt is retracted and the activation bolt extends when the latch bolt is retracted.

The retractor portions 64*a* and 64*b* are each pivoted around pivot 66. They move relative to each other, as described below, to allow both the latch bolt and activation bolt to be retracted at the same time as is needed when the doors are being opened or closed. Both the activation bolt and the latch bolt are spring loaded towards the extended position. In the design shown, the activation bolt spring 68 operates between the case and the second portion of the retractor 64*b* and is stronger than the springs trying to extend the latch bolt. Thus, when neither the activation bolt nor the latch bolt is obstructed, the activation bolt 22 will extend as shown in FIG. 2, and the latch bolt 18 will be retracted by the first portion of the retractor 64*a*.

The latch bolt spring 72 is located around pivot 66 which holds the first portion 64*a* and the second portion 64*b* of the retractor in the relative positions seen in FIG. 2. The activation bolt 22 is operated by the retractor 64*b* through slide 74. The extension length of the latch bolt 18 is adjustable by pulling outward on the latch bolt 18 when it is in the extended position. This disengages the latch bolt from the latch bolt tail and compresses compression spring 76. When compression spring 76 is compressed, it disengages the head of adjustment screw 78 from two press fit pins, 80,82, allowing the adjustment screw to be turned in its threaded engagement 84 with the latch bolt tail. As it turns, the extension length of the latch bolt 18 is adjusted.

It will be noted from FIGS. 1 and 2 that the latch bolt has the general shape and configuration of a deadbolt and does not include angled surfaces intended to contact the strike plate on the opposing passive mortise latch mechanism as is needed for other designs. Instead, the latch bolt is retracted by the more powerful spring extension of the activation bolt 22. This dead bolt type of shape makes it difficult to make an unauthorized entry by forcing the latch bolt back into the mortise mechanism. The front surface of the latch bolt 18 is a push surface 89 which is substantially perpendicular to the axis of the latch bolt.

The activation bolt 22 includes angled surfaces on both sides allowing it to be pushed back into the active mortise latch mechanism 10 whenever the two doors come into alignment. This alignment can be achieved either by closing the active door 12 against a previously closed passive door 16 or it may be achieved by closing passive door 16 against a previously closed active door 12. There is no requirement that either door be opened first or closed first. Whenever the activation bolt 22 begins to be pushed inward to the retracted position by the opposing door, the latch bolt becomes free to move toward the extended position. However, by this time the doors will be nearly into alignment and the latch bolt will be held in the retracted position by the obstructing position of the strike plate lips 21, 23 (see FIG. 1) on the passive mortise latch mechanism. When door alignment is achieved, the latch bolt will be spring driven forward into opening 20 in the passive latch mechanism (or into a strike plate in a single door installation) by the latch bolt spring.

Figure 3:
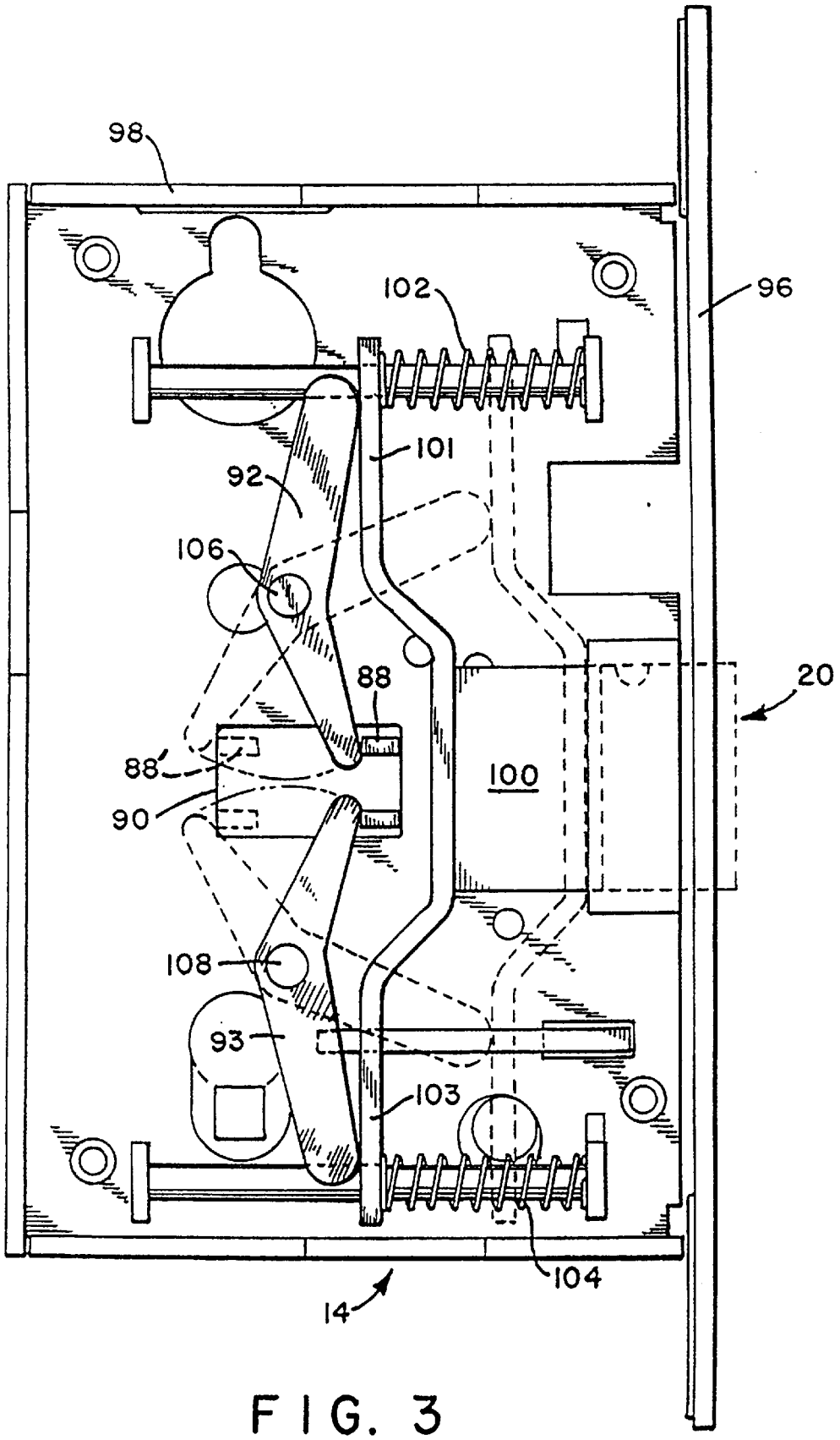
FIG. 3 is a front elevational view of the passive mortise latch mechanism according to the invention with the cover removed to show the internal mechanism. The passive mortise latch mechanism has its pusher slide and pivot arms shown in solid lines in the receiving position. The phantom dotted lines show the pusher slide and pivot arms in the ejecting position.
Figure 4:
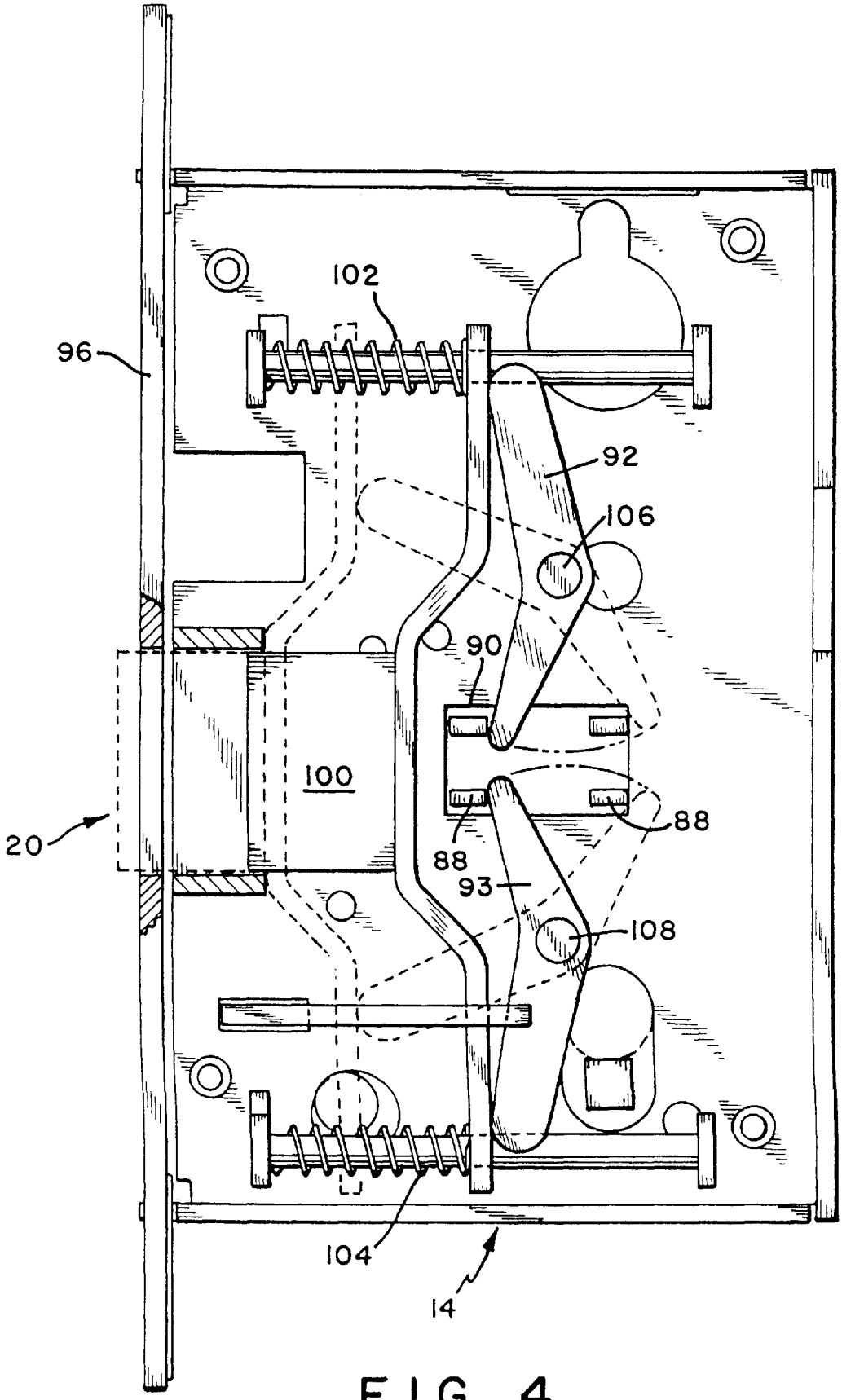
FIG. 4 is a back elevational view of the passive mortise latch mechanism shown in FIG. 3 with the cover removed to show the internal mechanism. As in FIG. 3 the solid lines show the pusher slide and pivot arms in the receiving position and the phantom dotted lines show the pusher slide and pivot arms in the ejecting position.

FIGS. 3 and 4 illustrate the passive mortise latch mechanism 14 from the front and back respectively. The passive mortise latch mechanism is significantly different from the active mortise latch mechanism, just described. However, the operating mechanism 26 which drives the passive mortise latch mechanism, and all the surface mounted components on the passive door 16, are essentially identical to or mirror images of the corresponding operating mechanism 24 for the active mortise latch.

Operating member 88 includes a forked end that protrudes through the surface of the passive door and into the passive mortise latch mechanism 14 through operating opening 90 in the case thereof. The forked end of the operating member 88 contacts a pair of pivot arms 92, 93 and moves them between the position shown in solid lines and the position shown in dashed lines.

The solid line shows the pivot arms in the normal non-operated positions. These are the positions they have when the passive door is not actually being opened, i.e., when the arm 94 has not been moved towards the passive door to the open position. When the passive door is being opened, arm 94 on operating mechanism 26 swings towards the passive door 16 and the forked end of the operating member 88 moves to the left to position 88' in FIG. 3. The motion of the operating member to position 88' causes the pivot arms 92, 93 to pivot around their respective pivots 106, 108 to the positions shown in dotted lines. The pivot arms 92, 93 each include a first end for operation by the operating member 88 and a second end for operating the pusher slide.

The case 98 of the passive mortise latch mechanism includes an edge surface 96 arranged to be flush mounted with the edge surface of passive door 16. Inside the case is a pusher slide 100 driven by a pair of slide arms 101, 103. The slide arms are spring loaded to the left in FIG. 3 via pusher springs 102, 104. The pusher springs hold the pusher slide 100 in the receiving position (to the left in FIG. 3) which keeps opening 20 unobstructed and allows the latch bolt 18 to enter the opening 20.

When operating mechanism 26 moves the operating member toward the position marked 88', it swings the pivot arms 92, 93 and drives the pusher slide into the ejecting position shown in dotted lines. This action ejects the latch bolt 18 from opening 20 allowing the passive door 16 to open even while the active door 12 remains closed. The pusher slide pushes against the push surface 89 of the latch bolt as it ejects the latch bolt from opening 20.

Figure 5:
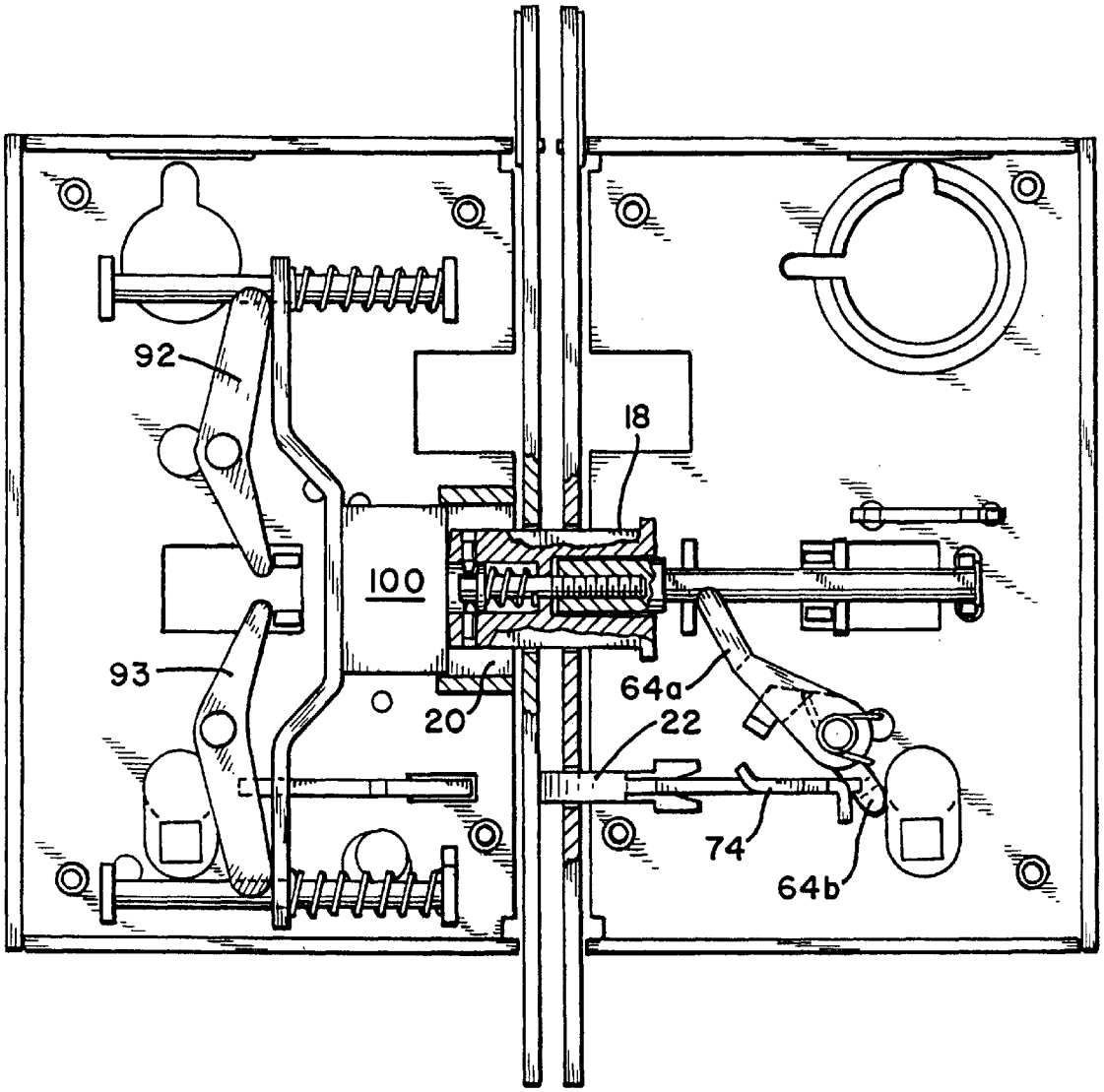
FIG. 5 is a front elevational view of the active mortise latch mechanism of FIG. 2 aligned with the passive mortise latch mechanism of FIGS. 3 and 4, as occurs when the first and passive doors are closed. The active mortise latch mechanism on the right is shown in the closed position with the latch bolt extended and the activation bolt retracted. The passive mortise latch mechanism on the left shows the pusher slide and pivot arms in the receiving position.
Figure 6:
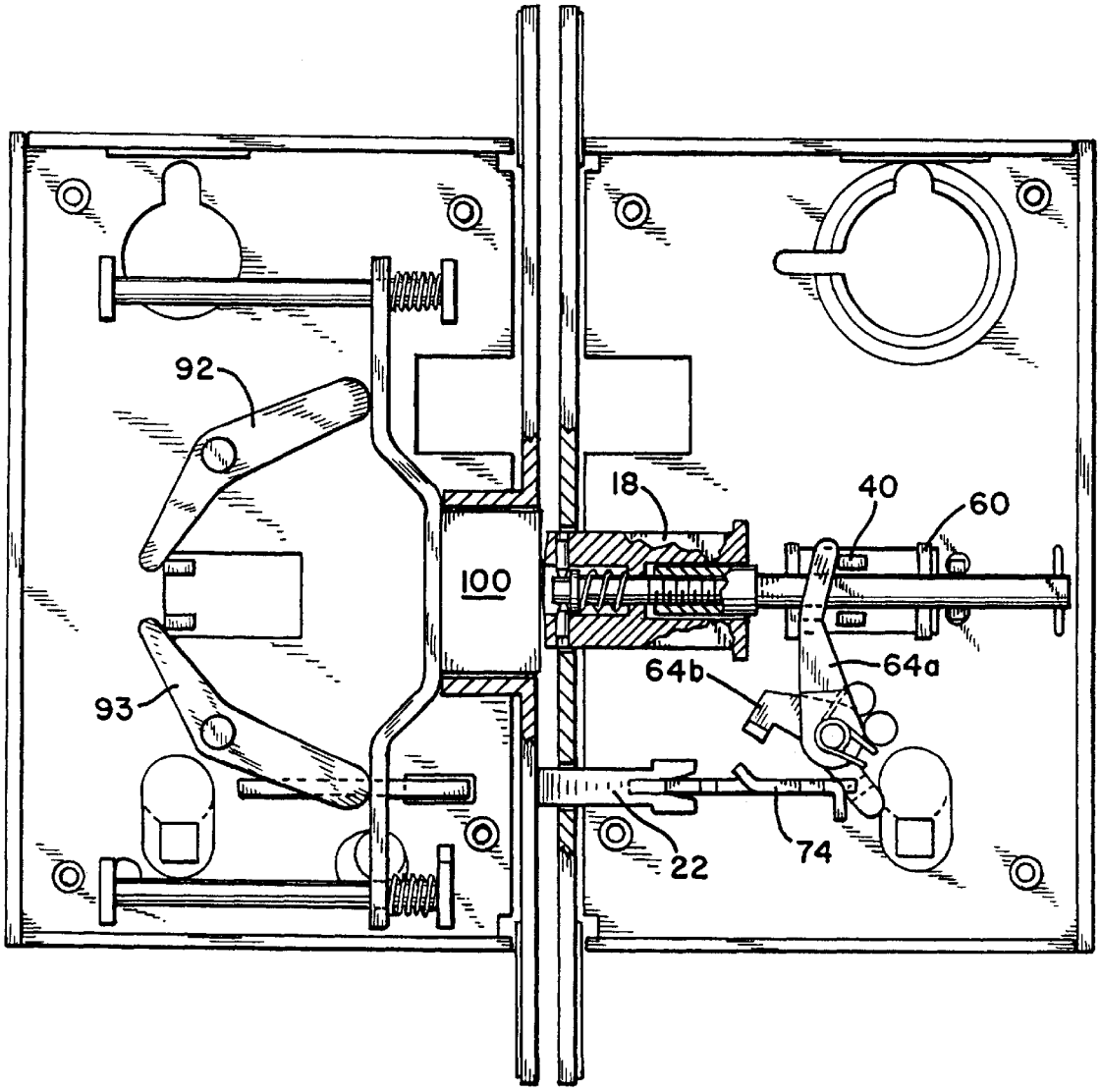
FIG. 6 is a front elevational view of the active and passive mortise latch mechanisms of FIG. 5, except that the active mortise latch mechanism on the right is shown with both the latch bolt and the activation bolt in the retracted positions as occurs just prior to one of the doors being opened and the passive mortise latch mechanism shows the pusher slide and the pivot arms in the ejecting position.

It will be understood that just prior to the time the passive door 16 opens, both the activation bolt 22 and the latch bolt 18 will be in the retracted position in the active mortise latch mechanism 10. FIGS. 5 and 6 illustrate the manner in which the active and passive mortise latch mechanisms cooperatively interact to allow either door to open or close first. They also illustrate the operation of the first and second portions 64*a*, 64*b* of the retractor which allows the latch bolt and activation bolt to be simultaneously in the retracted positions as needed to open and close the two doors in any order.

In both FIG. 5 and FIG. 6 the doors 12, 16 are closed and are in alignment. In FIG. 5 latch bolt 18 is extended and engages opening 20 in the passive mortise latch mechanism. This is the normal latched position for the doors.

In FIG. 6, latch bolt 18 is in the retracted position and has been ejected from opening 20 by the pusher slide 100. This is the configuration of the doors when the push rail on the passive door has been pressed and the passive door is just about to be opened, with the active door still closed. The right side of FIG. 6 shows how the two halves of the retractor move relative to each other to allow the latch bolt and the activation bolt to be simultaneously retracted. The activation bolt 22 is held in the retracted position by the strike plate of the passive mortise latch. This holds the second retractor portion 64*b* in the same position shown in FIG. 5 (doors aligned). The latch bolt 18 is being held in the retracted position by the pusher slide 100. This holds the first portion 64*a* of the retractor in the same position shown in FIG. 2 (doors not aligned).

Provided the push rails of both doors are released, when the two doors are moved into alignment from the position of FIG. 5, the latch bolt will extend and the first portion of the retractor 64*a* will move. On the other hand, if the two doors are moved out of alignment (and the push rail opening mechanisms are not depressed), the activation bolt will extend and the second portion of the retractor 64*b* will move. The spring connection between each of the two portions and between those portions and the case ensure that the activation bolt extends whenever it is not blocked and that the latch bolt is retracted whenever the activation bolt is extended.

While the present invention has been particularly described in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An active mortise latch mechanism for mounting in the edge of a door comprising:

a case having an edge surface for mounting approximately flush with the edge of the door;

a latch bolt movable between an extended and a retracted position relative to the edge surface of the case;

an activation bolt movable between an extended and a retracted position relative to the edge surface of the case;

a retractor pivotally connected between the latch bolt and the activation bolt, the retractor being driven by the activation bolt to retract the latch bolt when the activation bolt is extended;

a latch bolt spring connected to extend the latch bolt when the activation bolt is in the retracted position;

an activation bolt spring connected to extend the activation bolt, the activation bolt spring having sufficient strength to extend the activation bolt and retract the latch bolt when the activation bolt is not obstructed.

2. An active mortise latch mechanism according to claim 1 wherein the latch bolt includes a push surface and the latch bolt, retractor and activation bolt are interconnected such that the latch bolt is free to be pushed to the retracted position when the activation bolt is also in the retracted position.

3. An active mortise latch mechanism according to claim 1 wherein the retractor includes first and second relatively movable portions, the first retractor portion contacting and moving with the latch bolt and the second retractor portion contacting and moving with the activation bolt, the second retractor portion contacting and driving the first retractor portion when the retractor is retracting the latch bolt and the relative motion between the first and second retractor portions allowing the latch bolt to be pushed to the retracted position when the activation bolt is also in the retracted position.

4. An active mortise latch mechanism according to claim 3 wherein the latch bolt spring comprises a spring operating between the first portion of the retractor and the second portion of the retractor.

5. An active mortise latch mechanism according to claim 1 wherein the case includes an operating opening adapted to receive an operating member from an operating mechanism.

6. An active mortise latch mechanism according to claim 5 in combination with an operating mechanism, the operating mechanism comprising:

a chassis having a surface for mounting on a face of the door in close proximity to the case of the mortise latch mechanism;

an opening mechanism movably mounted to the chassis for motion between an open and a closed position;

an operating member driven by the opening mechanism, the operating member projecting through the chassis surface into the case of the mortise latch mechanism and moving the latch bolt to the retracted position when the opening mechanism is moved to the open position.

7. An active mortise latch mechanism according to claim 6 wherein the opening mechanism comprises a push rail and the operating mechanism includes at least one vertical rod extending to a vertical rod latch mechanism adapted for mounting near an upper edge of the door.

8. An active mortise latch mechanism according to claim 1 in combination with a passive mortise latch mechanism, the passive mortise latch mechanism comprising:

a case for the passive mortise latch mechanism having an edge surface for mounting approximately flush with an edge of a passive door;

an opening in the edge surface of the case of the passive mortise latch mechanism for receiving the latch bolt of the active mortise latch mechanism;

a pusher slide movable between receiving and ejecting positions, the pusher slide having a pusher surface for pushing and ejecting the latch bolt of the active mortise latch mechanism from the opening in the case of the passive mortise latch mechanism when the pusher slide is in the ejecting position.

9. An active mortise latch mechanism in combination with a passive mortise latch mechanism according to claim 8, wherein the passive mortise latch mechanism further includes:

at least one pusher slide spring connected to urge the pusher slide towards the accepting position;

an operating opening in the case of the passive mortise latch mechanism adapted to receive an operating member from an operating mechanism.

10. An active mortise latch mechanism in combination with a passive mortise latch mechanism according to claim 9, wherein the passive mortise latch mechanism further includes at least one pivot arm pivotally mounted to the case of the passive mortise latch mechanism, the pivot arm having a first end for operation by an operating member from an operating mechanism and a second end for operating the pusher slide.

11. An active mortise latch mechanism in combination with a passive mortise latch mechanism according to claim 10, wherein the passive mortise latch mechanism includes two pivot arms pivotally mounted to the case of the passive mortise latch mechanism, each pivot arm having a first end for operation by an operating member from an operating mechanism and a second end for operating the pusher slide, the pivot arms being pivotally mounted to the case of the passive mortise latch mechanism on opposite sides of the operating opening.

12. A double door latching system for latching active and passive doors, the double door latching system comprising:

an active mortise latch mechanism for mounting in the edge of the active door, the active mortise latch mechanism including a latch bolt, the latch bolt retracting when the active and passive doors are not in alignment and extending when the active and passive doors are aligned;

a first operating mechanism, adapted for mounting on the active door, the first operating mechanism including a first opening mechanism movable between open and closed positions, the first operating mechanism being operatively connected to the active mortise latch mechanism to retract the latch bolt when the first opening mechanism is moved to the open position;

a passive mortise latch mechanism for mounting in the edge of the passive door, the passive mortise latch mechanism including a case, an opening in the case for receiving the latch bolt of the active mortise latch mechanism, and a pusher slide movable between receiving and ejecting positions, the pusher slide having a pusher surface for pushing and ejecting the latch bolt of the active mortise latch mechanism from the opening in the case of the passive mortise latch mechanism when the pusher slide is in the ejecting position; and a second operating mechanism, adapted for mounting on the passive door, the second operating mechanism including a second opening mechanism movable between open and closed positions, the second operating mechanism being operatively connected to the passive mortise latch mechanism to move the pusher slide to the ejecting position when the second opening mechanism is moved to the open position.

13. A double door latching system according to claim 12, wherein the first and second operating mechanisms each includes a single vertical rod and a single vertical rod latch mechanism.

14. A double door latching system according to claim 12, wherein the active mortise latch mechanism further includes an activation bolt movable between an extended and a retracted position, the activation bolt contacting the passive mortise latch mechanism when the active and passive doors are aligned to move the activation bolt to the retracted position and move the latch bolt to the extended position.

15. A double door latching system according to claim 14 wherein the active mortise latch mechanism further includes a retractor pivotally connected between the latch bolt and the activation bolt to retract the latch bolt when the activation bolt is extended.

16. A double door latching system according to claim 15 wherein the retractor includes first and second relatively movable portions, the first retractor portion moving the latch bolt and the second retractor portion moving the activation bolt.

17. A double door latching system according to claim 16 further including a retractor spring to extend the activation bolt and retract the latch bolt when the active and passive doors are not in alignment.

18. A double door latching system according to claim 17 further including a latch bolt spring to extend the latch bolt when the activation bolt is retracted.

19. A double door latching system according to claim 18 wherein the latch bolt spring and retractor spring are in opposition, the retractor spring having sufficient strength to extend the activation bolt and retract the latch bolt when the activation bolt is not obstructed.

20. A double door latching system comprising:

an active mortise latch mechanism for mounting in the edge of an active door, the active mortise latch mechanism including:

a case, a latch bolt movable between an extended and a retracted position relative to the case, an activation bolt movable between an extended and a retracted position relative to the case, and a latch bolt spring operable between the latch bolt and the activation bolt for urging the latch bolt towards the extended position when the activation bolt is in the retracted position;

a first operating mechanism for mounting on a face of the active door adjacent to the active mortise latch mechanism, the first operating mechanism including:

a single vertical rod, a single vertical rod latch mechanism adapted for mounting near an upper edge of the active door, the vertical rod latch mechanism being driven by the vertical rod, an opening mechanism movable between an open and a closed position, and an operating member extending from the operating mechanism to the active mortise latch mechanism;

a passive mortise latch mechanism for mounting in the edge of a passive door, the passive mortise latch mechanism including:

a case;

an opening in the case of the passive mortise latch mechanism for receiving the latch bolt of the active mortise latch mechanism;

a pusher slide movable between receiving and ejecting positions, the pusher slide having a pusher surface for pushing and ejecting the latch bolt of the active mortise latch mechanism from the opening in the case of the passive mortise latch mechanism when the pusher slide is in the ejecting position; and a second operating mechanism for mounting on the face of the passive door adjacent to the active mortise latch mechanism, the second operating mechanism including:

a single vertical rod, a single vertical rod latch mechanism adapted for mounting near an upper edge of the passive door, the vertical rod latch mechanism being driven by the vertical rod, an opening mechanism movable between an open and a closed position, and an operating member extending from the second operating mechanism to the passive mortise latch mechanism.

21. A high security double door latching system comprising:

an active mortise latch mechanism for mounting in the edge of an active door, the active mortise latch mechanism including:

a case, a latch bolt movable between an extended and a retracted position relative to the case, an activation bolt movable between an extended and a retracted position relative to the case, and latch bolt spring operable between the latch bolt and the activation bolt for urging the latch bolt towards the extended position when the activation bolt is in the retracted position;

a first operating mechanism for mounting on a face of the active door adjacent to the active mortise latch mechanism, the first operating mechanism including:

a pair of vertical rods, a first vertical rod latch mechanism adapted for mounting near an upper edge of the active door, the first vertical rod latch mechanism being driven by one of the first pair of vertical rods, a second vertical rod latch mechanism adapted for mounting near a lower edge of the active door, the second vertical rod latch mechanism being driven by the other of the first pair of vertical rods, a first opening mechanism movable between an open and a closed position, and a first operating member extending from the operating mechanism to the active mortise latch mechanism;

a passive mortise latch mechanism for mounting in the edge of a passive door, the passive mortise latch mechanism including:

a case;

an opening in the case of the passive mortise latch mechanism for receiving the latch bolt of the active mortise latch mechanism;

a pusher slide movable between receiving and ejecting positions, the pusher slide having a pusher surface for pushing and ejecting the latch bolt of the active mortise latch mechanism from the opening in the case of the passive mortise latch mechanism when the pusher slide is in the ejecting position; and a second operating mechanism for mounting on the face of the passive door adjacent to the active mortise latch mechanism, the second operating mechanism including:

a second pair of vertical rods, a third vertical rod latch mechanism adapted for mounting near an upper edge of the passive door, the third vertical rod latch mechanism being driven by one of the second pair of vertical rods, a fourth vertical rod latch mechanism adapted for mounting near a lower edge of the passive door, the fourth vertical rod latch mechanism being driven by the other of the second pair of vertical rods, a second opening mechanism movable between an open and a closed position, and a second operating member extending from the second operating mechanism to the passive mortise latch mechanism.

* * * * *